US006983625B2

(12) United States Patent
Weber et al.

(10) Patent No.: US 6,983,625 B2
(45) Date of Patent: Jan. 10, 2006

(54) CIRCULAR KNITTING MACHINE WITH A WORKING PLATFORM AND CONSTRUCTION KIT FOR MAKING SAME

(75) Inventors: Helmut Weber, Albstadt (DE); Ingo Vogt, Wessingen (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 10/863,404

(22) Filed: Jun. 8, 2004

(65) Prior Publication Data

US 2004/0250574 A1 Dec. 16, 2004

(30) Foreign Application Priority Data

Jun. 10, 2003 (DE) ..... 103 26 514

(51) Int. Cl.
*D04B 9/00* (2006.01)

(52) U.S. Cl. ..... 66/8

(58) Field of Classification Search ..... 66/8, 66/147–153, 1 R; 108/42–49, 50.01, 50.11, 108/50.14, 50.16, 50.17, 51.11, 54.1, 57.15; 297/217.1, 297.7

See application file for complete search history.

(56) References Cited

U.S. PATENT DOCUMENTS

| | | | | | |
|---|---|---|---|---|---|
| 553,108 | A | * | 1/1896 | Davison | 297/142 |
| 3,855,822 | A | | 12/1974 | Lee | |
| 3,959,991 | A | | 6/1976 | Brown | |
| 3,959,992 | A | | 6/1976 | Eschenbach | |
| 4,033,147 | A | | 7/1977 | King | |
| 4,765,155 | A | * | 8/1988 | Pernick | 66/8 |
| 6,568,221 | B2 | * | 5/2003 | Seeger et al. | 66/8 |

FOREIGN PATENT DOCUMENTS

| | | |
|---|---|---|
| DE | 1 730 206 | 9/1956 |
| DE | 199 23 217 A1 | 11/2000 |
| EP | 0 696 658 | 2/1996 |

* cited by examiner

*Primary Examiner*—Danny Worrell
(74) *Attorney, Agent, or Firm*—Michael J. Striker

(57) ABSTRACT

What is described is a circular knitting machine with a chassis (1) and means for manufacturing knitted goods. According to the invention, the circular knitting machine has at least one working platform (14) facilitating access to an upper region, and mounted on the outside of the chassis (1), said working platform being displaceably mounted on a guideway attached to the chassis (1) and running in its peripheral direction (FIG. 3).

15 Claims, 6 Drawing Sheets

CIRCULAR KNITTING MACHINE WITH A WORKING PLATFORM AND CONSTRUCTION KIT FOR MAKING SAME

FIELD OF THE INVENTION

The invention concerns a circular knitting machine having a chassis, means for manufacturing knitted goods and at least one working platform facilitating access to an upper region of the machine, movably mounted on the outside of the chassis and extending over a fraction of its periphery.

BACKGROUND OF THE INVENTION

In the case of circular knitting machines with large structural heights and/or large diameters, it is often difficult, particularly for smaller persons, to reach devices arranged at an upper region of the machine, in particular devices for the manufacturing of a knitted product, such as needle cams, yarn guides, yarn supply devices, or similar, although this is essential for carrying out adjustment, repair and servicing work. A circular knitting machine with a raised working platform is therefore already known (DE 1 730 206 U1), which is designed as a walkway arranged along the periphery of the machine chassis, runs at a certain height above the floor and is firmly attached to the machine chassis and accessible to the persons operating the circular knitting machine. However, a walkway of this type makes access to the equipment arranged in a lower region of the circular knitting machine difficult or impossible. This is especially the case in relation to the usually present drawing-off and/or winding devices, since for safety reasons, these are usually surrounded by a protective cover having at least one door that is designed for being opened if necessary in order, for instance, to remove a finished fabric batch.

Additionally, circular knitting machines of the aforementioned type are known (U.S. Pat. Nos. 3,959,991, 3,959,992 and 4,033,147), whereby the working platform extends only over a (small) fraction of the machine periphery and is pivotable as a whole together with or independently of a door provided in the protective cover. By this means, it is possible without further difficulty to open the door if required and to remove the fabric batch, possibly after pivoting the working platform away. Contrasted with the advantage, thereby achieved, of improved function is the disadvantage that easier access to the means intended for manufacturing the knitted goods is available either only on a small part of the periphery of the circular knitting machine, or that a plurality of working platforms and pivoting mechanisms have to be arranged round the periphery of the circular knitting machine, which brings with it an increased design and financial cost.

SUMMARY OF THE INVENTION

An object underlying this invention is to so design the circular knitting machine mentioned above that without great additional constructional changes a simplified access to the equipment provided in the upper region of the machine is possible.

An further object of this invention is to so design the circular knitting machine mentioned above that simplified access to the equipment provided in the upper region of the machine is possible substantially along the entire periphery of the machine chassis.

Yet another object of this invention is to provide a kit for making a working platform and mounting the platform on a circular knitting machine of the kind specified above.

These and other objects are solved by a circular knitting machine being characterised in that the working platform is displaceably mounted on a guideway attached to the chassis and running in its peripheral direction.

A construction kit for a working platform is characterised in that it has a guideway designed for attaching to a chassis of a circular knitting machine and at least one working platform designed for being connectable to the guideway and displaceable along the guideway.

The invention proposes for the first time a working platform which is movable in the peripheral direction of the machine chassis and may therefore be designed relatively narrow, so that it does not represent a hindrance when not used. The latter applies even if the machine chassis is provided with a plurality of radially projecting feet and if, in order to avoid too large a radial extent of the circular knitting machine, a plurality of working platforms is provided such that each platform is movable between two respective adjacent feet.

Further advantageous features of the invention are disclosed in the subclaims.

BRIEF DESCRIPTION OF THE DRAWINGS

The invention will now be described in greater detail using examples with the aid of the drawings, in which.

DETAILED DESCRIPTION OF PREFERRED EMBODIMENTS OF THIS INVENTION

Figure 1:
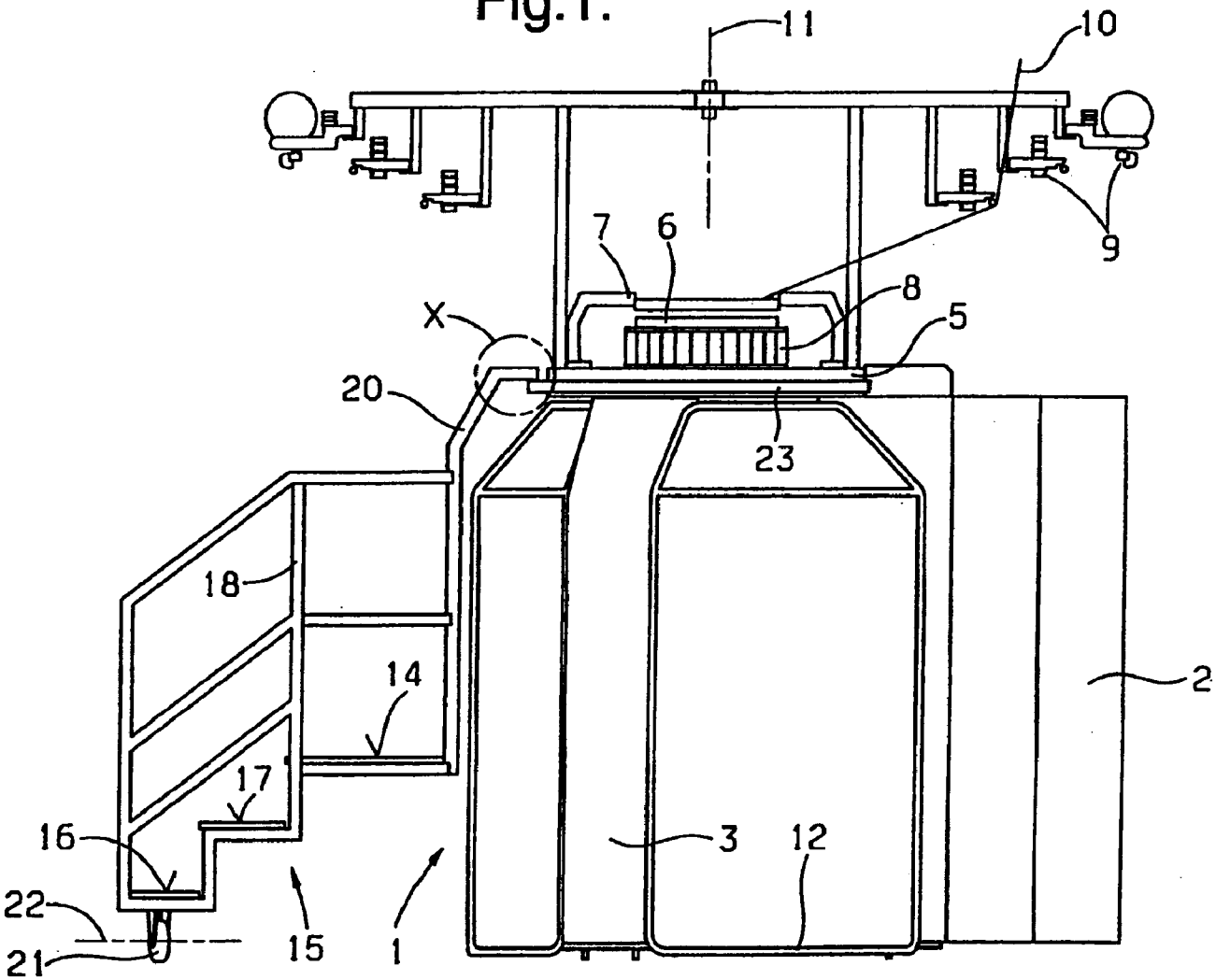
FIG. 1 shows a schematic side view of a circular knitting machine according to the invention.
Figure 2:
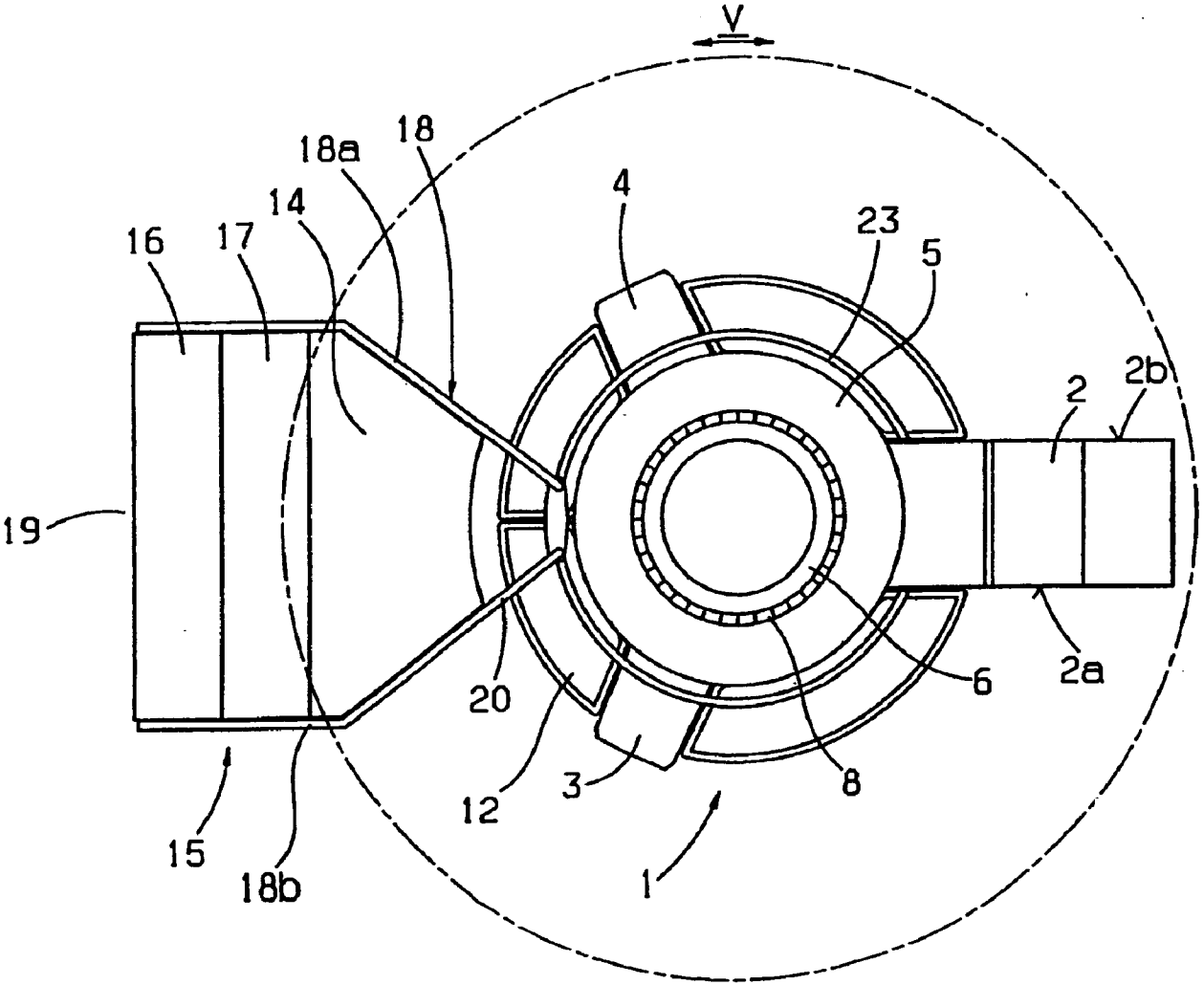
FIG. 2 shows a plan view of the circular knitting machine according to FIG. 1 leaving out the apparatus intended for feeding in the yarn.
Figure 3:
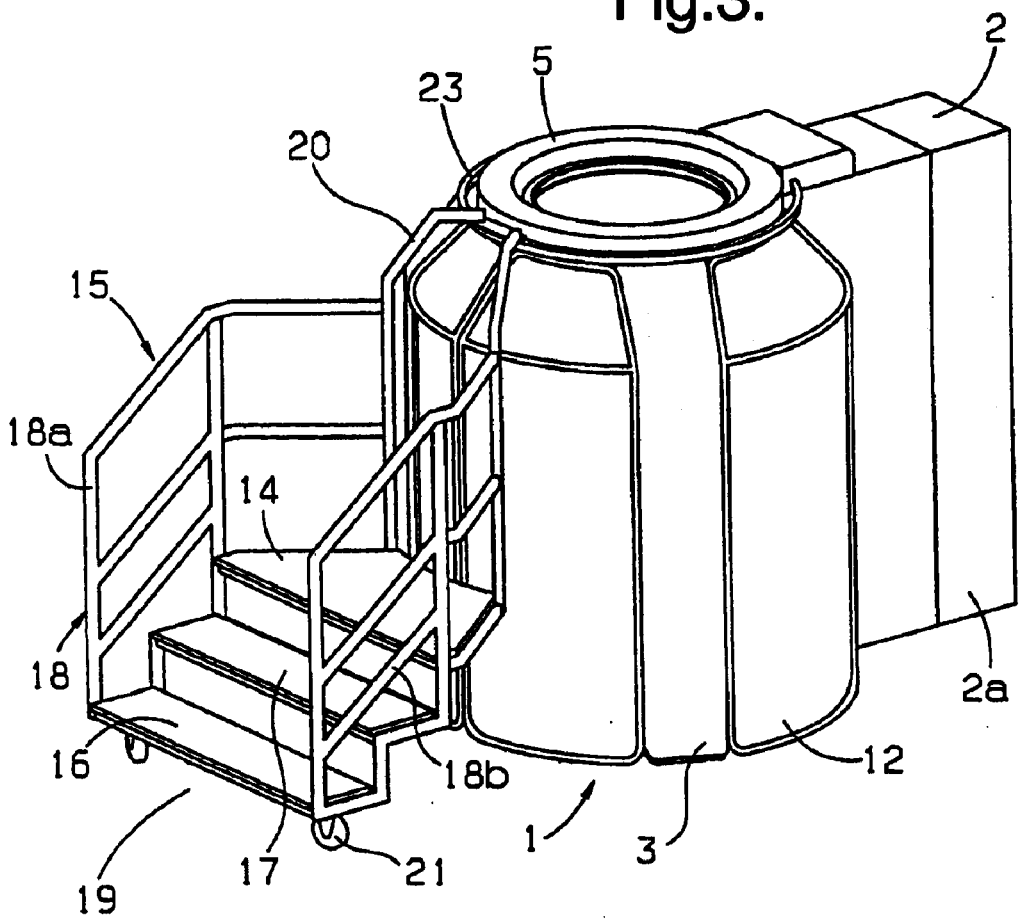
FIG. 3 shows a perspective view of the circular knitting machine according to FIG. 2.

FIGS. 1 to 3 show, in schematic form, a circular knitting machine with a frame or chassis 1 having a plurality of feet 2, 3 and 4 (FIG. 2) on which is borne a support ring 5 (FIGS. 1, 2). The support ring 5 serves, for instance, for the rotatable mounting of a needle cylinder 6 and for the stationary mounting of a yarn carrier ring 7 provided with a plurality of yarn guides, a cam box ring 8 surrounding the needle cylinder 6, a plurality of yarn feed devices 9 for feeding the yarns 10 to the knitting needles mounted in the needle cylinder 6, and other devices denoted here simply as means for manufacturing a hose-shaped knitted product which are mounted in an upper region of the circular knitting machine.

The feet 3 and 4 are separated from the foot 2 in the embodiment at an angular separation of ca. 110°, whereas the angular separation of the feet 3 and 4 from each other is ca. 140°, and arranged at a sufficient radial separation from a central machine axis 11 (FIG. 1). The foot 2 is a main foot, which serves to accommodate a drive motor (not shown in further detail) or other electrical or electronic components and operating elements for the circular knitting machine, whereas the feet 3 and 4 are side feet which, except for a switching unit possibly present, are free from such assemblies. The main foot 2 therefore stands out radially substantially more than the side feet 3 and 4 from the machine chassis 1.

Below the support ring 5 and in the region bordered by the feet 2, 3 and 4, the chassis 1 has a lower support ring (not shown) for a drawing-off and/or winding device by means of which knitted goods produced in the circular knitting machine may be drawn off and wound up. It is unimportant, in principle, whether the knitted goods are only drawn off, only wound, or are drawn off and wound by this device.

The circular knitting machine is also provided with a protective cover 12 (FIGS. 1 to 3), which substantially extends from the support ring 5 to the lower ends of the feet 2, 3 and 4 arid covers the drawing-off and/or winding device on its outer periphery in order to prevent injury to the operating personnel by rotating parts during operation of the circular knitting machine. As is known, the protective cover 12 may be provided with at least one door which may be opened or closed and enables access to the drawing-off and/or winding device or to the lower region of the circular knitting machine.

Circular knitting machines of this type are generally known to persons skilled in the art (e.g. U.S. Pat. No. 3,855,822, DE 199 24 217 A1) and therefore do not need to be described in greater detail.

In the example of the invention schematically shown in FIGS. 1 to 4 and regarded as the best embodiment of the invention up to now, the circular knitting machine has a working platform 14 which extends in the peripheral direction (double arrow v in FIG. 2) over only a fraction of the chassis 1 and is arranged on its exterior. The working platform 14, which could also be designated as a platform, step surface, short walkway or similar, is arranged in the example so high above the ground or the support surface of the feet 2 to 4 that persons standing on it can easily reach all the important machine parts or apparatus situated in the upper region of the circular knitting machine. If the working platform 14 is arranged at a relatively great height, then it preferably comprises the uppermost step of a set of steps 15. The set of steps 15 has two additional steps 16 and 17 in the example and the working platform 14 as the third step. The individual steps 16, 17 and 14 are arranged one behind the other substantially radially to the machine axis 11 so that, seen in the peripheral direction, the whole set of steps 15 may occupy substantially the same space as the working platform 14, or a somewhat smaller or larger space than the working platform 14 according to need, whereby in the example, the first named alternative applies (FIG. 2). Otherwise, in the example, the working platform 14 extends, for instance, over a region corresponding to approximately one seventh of the outer periphery of the chassis 1, although the invention is naturally not restricted to this amount.

For the protection of persons accessing the working platform 14, at least the working platform 14 and preferably the whole set of steps 15 is provided with a safety railing 18. This has in particular two side members 18*a*, 18*b* provided with handrails, which extend substantially radially from the lowest step 16 as far as the chassis 1. At the end lying radially outwards, the safety railing 18 is provided with an access opening 19 (FIG. 2) to the steps 15. On the other hand, at the end lying radially inwards, the safety railing 18 is provided with holding rods 20 whose importance is explained below.

The step 16 lying furthest outwards in the example is preferably supported on the floor by at least one roller 21 or similar which is rotatably mounted about a horizontal axis 22 (FIG. 1). Furthermore, it may be provided that the roller 21 is rotatably mounted on a bearing body, which itself is attached to the underside of the step 16 and is arranged rotatable about a vertical axis.

The working platform 14 and, with it, the set of steps is permanently affixed—though in case of need, detachably—to the chassis 1 and displaceable or moveable along its periphery in the direction of the double arrow v (FIG. 2). This is preferably brought about with the aid of a guideway or guide rail 23 shown enlarged in FIG. 4. This is designed with an annular form and is coaxial with the machine axis 11 and, for instance, at a height such that the upper ends 20*a* of the rods 20 grasp it when the steps 15 are arranged at the periphery of the chassis 1 and its step 16 is supported by the roller 21 on the ground. The guideway 23 is attached to the support ring 5 with the aid of radially arranged support rods 24.

Figure 4:
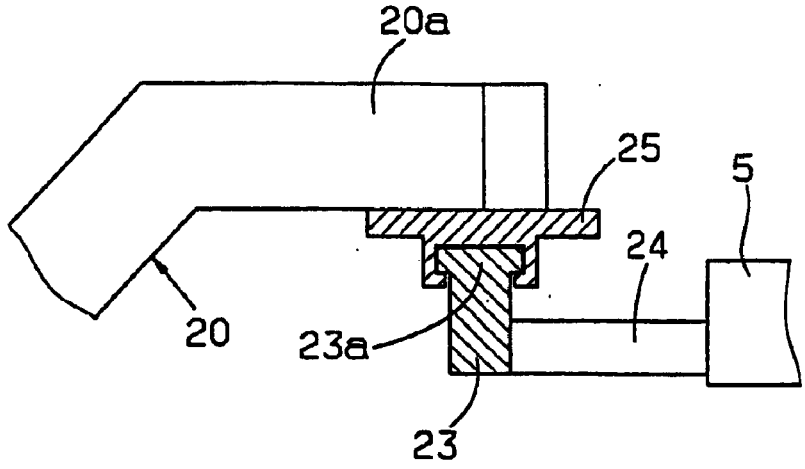
FIG. 4 shows an enlarged detail X of the circular knitting machine according to FIG. 1.
Figure 5:
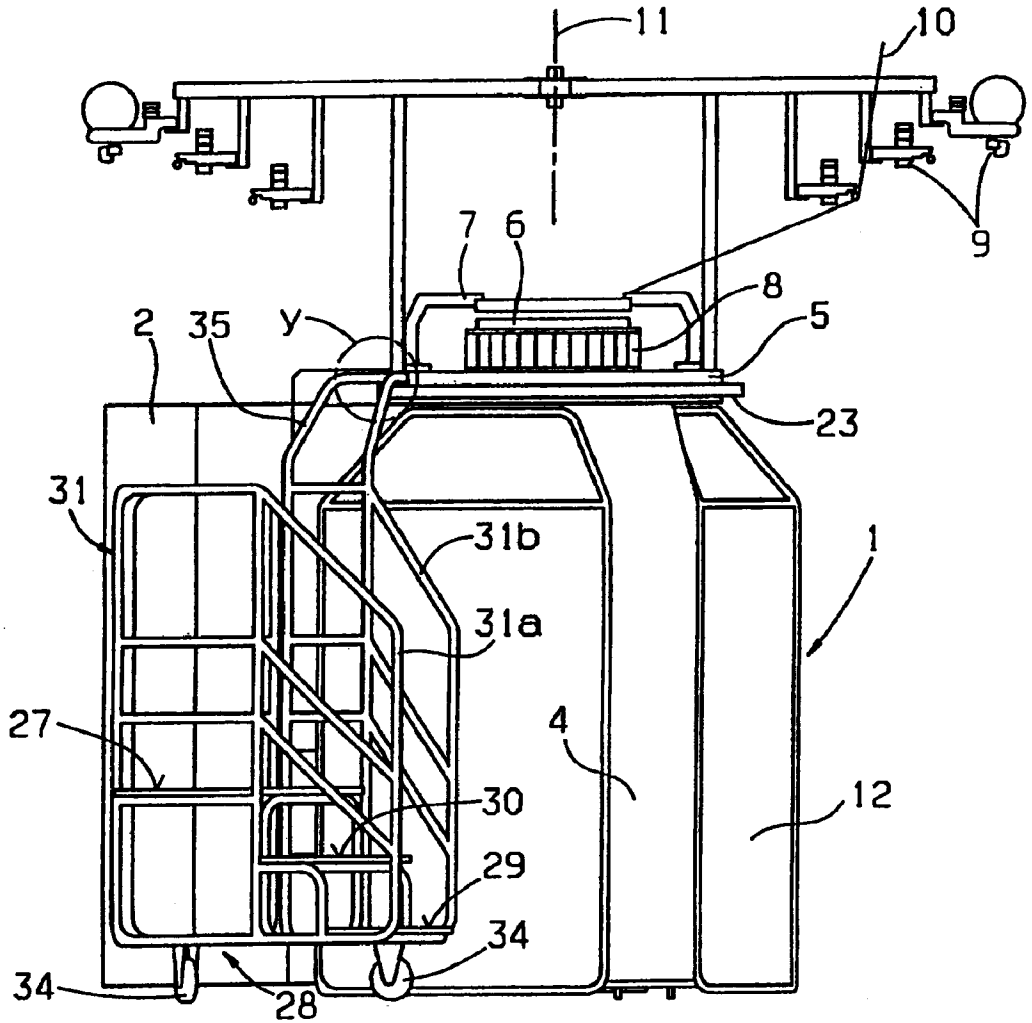
FIGS. 5 to 8 show views, according to FIGS. 1 to 4, of a second example of the circular knitting machine according to the invention.

According to FIG. 4, the guideway 23 is provided on its upper side with a circularly arranged profile 23*a* running in the peripheral direction and having the form of an I-beam or a T-beam which serves in bearing and guiding the ends 20*a* of the rods 20 lying radially inwards. For this purpose, the ends 20*a* have on their undersides U-shaped sliding elements 25 pushed onto the profile 23*a* of the guideway 23 and gripping it in the manner of clamps, which fix the whole set of steps 15 radially and substantially immovably to the guideway 23, but permitting displacement of the steps 15 in the peripheral direction of the chassis 1.

Due to the described design of the guideway 23, it is possible to move the working platform 14 or steps 15 in the peripheral direction (double arrow v) of the circular knitting machine and to arrange it along its periphery at the site where repair, maintenance, adjustment or similar is required.

In many cases, circular knitting machines are designed (FIGS. 2 and 4) such that they have at least one foot which is usually the main foot 2 which extends radially to the machine axis 11 and relatively far outwards. In order to avoid a case where the working platform 14 must also be moved past the outer radial extent of this main foot 2, which would result in a relatively large total diameter of the circular knitting machine, the invention provides for the radial separation of the working platform 14 from the machine axis 11 such that it may be moved past the side feet 3, 4 standing out less far, but that its movement path is limited by the two side surfaces 2*a*, 2*b* (FIG. 2) of the main foot 2 in that these side surfaces 2*a*, 2*b* act as stops for the working platform 14. By this means the positioning capability of the working platform 14 is somewhat restricted, but this impairs its function only slightly. If an operating person uses the working platform 14 in a position where it lies against one of the side surfaces 2*a*, 2*b*, then the operating person may also reach the space above the main foot 2.

Alternatively, cases may arise where more than one chassis foot extends further outwards radially, as is shown in FIG. 2 for the side feet 3 and 4. In this case, it may be suitable to keep the circle on which the working platform 14 or the steps 15 are able to move as small as possible by providing a working platform 14 or steps 15 as described between each two such chassis feet in such a manner that each of these chassis feet serves as a limit for its peripheral movement. This would also have the advantage that during work requiring two persons, a separate working platform is available to each of the two persons.

It is also clear to a person skilled in the art that the working platform 14 or steps 15 should be designed narrow and/or that any stop surfaces for them (e.g. 2*a*, 2*b*) should be arranged relative to each other such that the working platform 14 or steps 15 are displaceable into at least one position that permits opening of the door or doors of the protective cover 12 and removal of the goods batch thereby exposed.

This condition is easily fulfilled in particular when the doors of the protective cover 12 are designed as sliding doors, as for instance disclosed by the document DE 199 24 217 A1 which, for the sake of simplicity, is made the subject matter of the present disclosure by reference.

In the example according to FIGS. 5 to 8, similar parts are identified with the same reference numbers as in FIGS. 1 to 4. Therefore, in the following only the differences in this example that are significant for the invention will be explained.

According to FIGS. 5 to 8, a working platform 27 is provided which is designed as part of a set of steps 28. The set of steps 28 have two steps 29, 30 leading to the working platform 27, which in contrast to FIGS. 1 to 4, are not arranged radially, but substantially one behind the other in the peripheral direction of the circular knitting machine (double arrow w in FIG. 6). The widths of the working platform 27 and of the steps 29, 30 are substantially the same, whereby the three members 27, 29 and 30 suitably have side edges curved round the machine axis 11 in the manner of a spiral staircase. A safety railing 31 has corresponding curvatures, said railing being provided with side members 31*a*, 31*b* extending from the lowest step 29 to the chassis 1, also running in the peripheral direction, and having hand rails. Accordingly, seen in the peripheral direction, the steps 28 have an access opening 32 (FIG. 6) on their one end in the region of the first step 29, said opening being accessible only in the peripheral direction, whilst on the opposing end, a protective grid 33 (FIG. 6) is mounted.

Figure 6:
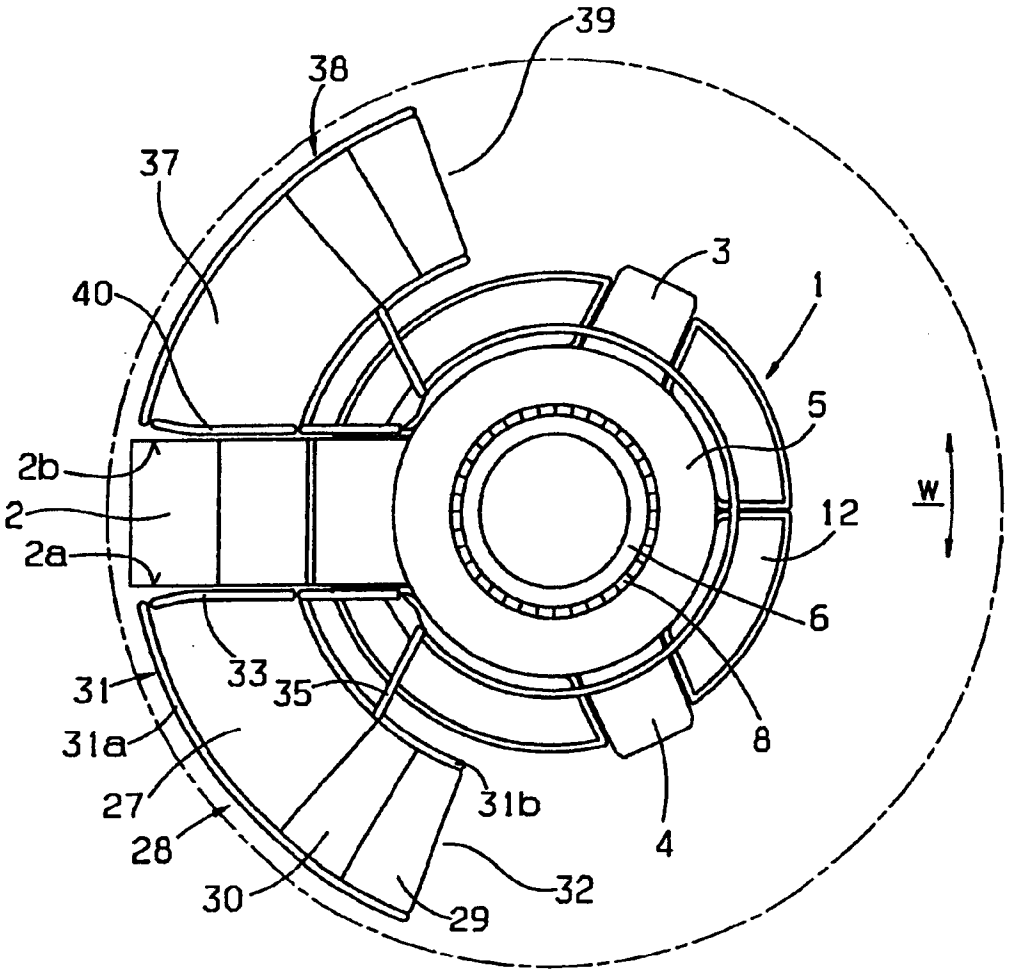
Figure 7:
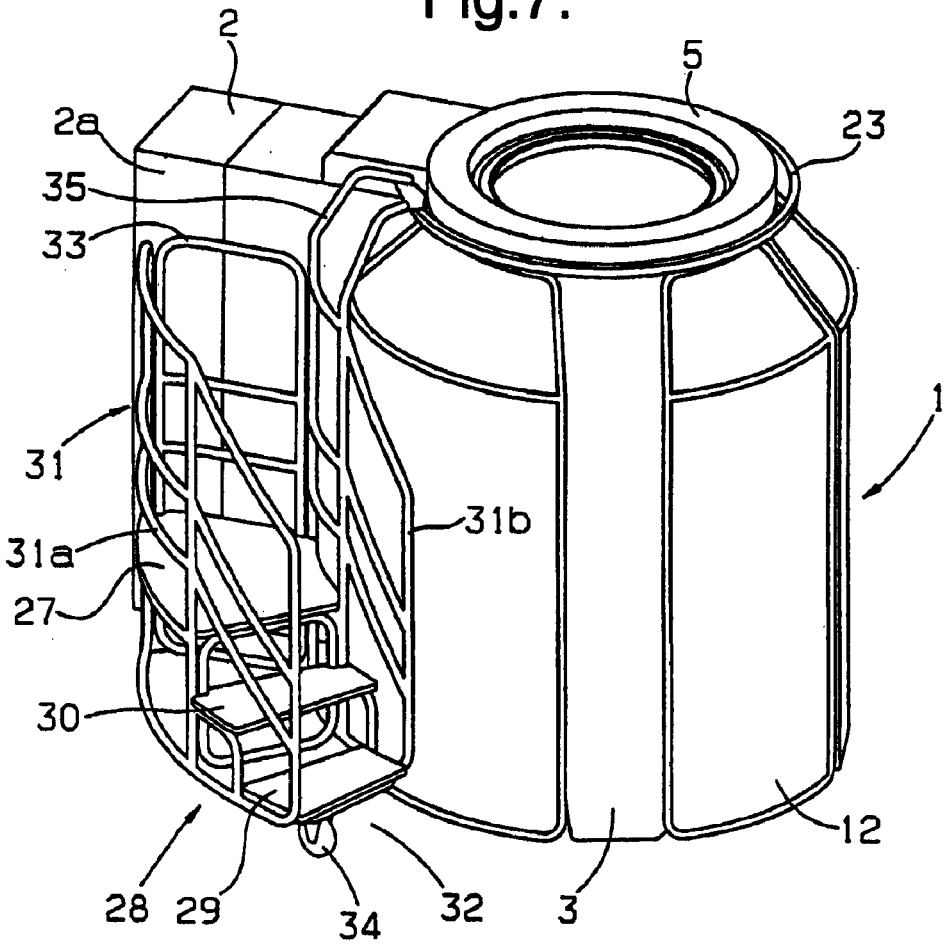
Figure 8:
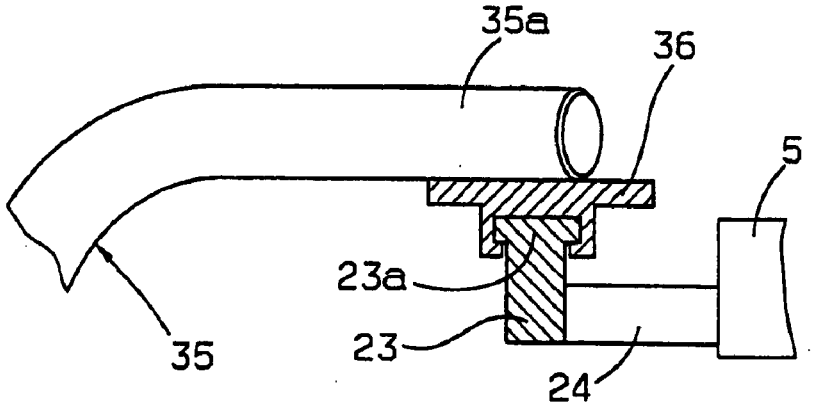

Whilst the lowest step 29 is suitably movably mounted on wheels or rollers 34, similarly to FIGS. 1 to 4, holding rods 35 equivalent to the holding rods 20 are attached to the side member 31*b* of the safety railing 31 lying radially inwards. The upper ends 35*a* of these holding rods 35 are provided, similarly to FIGS. 1 to 4, with sliding elements 36 which are placed with a sliding seating on the guideway 23 or its profile 23*a*, so that the working platform 27 or the steps 28 may be pushed to and fro in the peripheral direction w (FIG. 6). With regard to the feet 2, 3 or 4 extending far outwards radially, the same restrictions apply as explained above in connection with FIGS. 1 to 4.

As is apparent, in particular, from FIG. 6, in this example, also, two working platforms 27, 37 or sets of steps 28, 38 are provided whose movement paths are limited, for instance, by the two side surfaces 2*a*, 2*b* of the main foot 2. A second set of steps 38 which may possibly be present is provided, in similar manner to the steps 28, with an access opening 39 at one end and with a protective grid 40 on the other end. The two sets of steps 28, 38 are preferably designed and arranged with mirror symmetry to each other, so that their access openings 32, 39 either face each other, whilst their protective grids 33, 40 face in the direction of the side walls 2*a*, 2*b* of the main foot. It is thereby also possible to reach the working platforms 27, 37 via the access openings 32, 39 when the steps 28, 38 lie at the main foot 2.

Furthermore, the working platforms 27, 37 and the steps 28, 38 according to FIGS. 5 to 8 are substantially designed exactly like the working platform 14 and the steps 15 described above with the aid of FIGS. 1 to 4.

The invention is not restricted to the examples described, which may be subjected to derivation in a number of ways. In place of two steps leading to the working platform 14, 27, 37, depending upon the height of the respective circular knitting machine, no steps or only one or more than two steps may be provided. Furthermore, the geometrical forms of the working platforms and steps apparent from FIGS. 1 to 8 merely represent examples, which may be altered in any suitable manner. The same applies for the guideways 23 and profiles 23*a* and the sliding elements 25 or 36 sliding on these, in place of which other components may be provided, in particular for instance, in the form of ball or roller bearings. The materials from which the working platforms or steps are made are also freely selectable, although metals and particularly steel are preferred materials. Furthermore, the invention does not concern only circular knitting machines provided with the working platforms and steps according to the invention, but also kits with which existing circular knitting machines may be subsequently equipped with the working platforms and steps described and which therefore substantially contain the guideway 23, the slide elements 25 and 36, the holding rods 20, 35 and the components attached thereto. Finally, it is self-evident that the various features may also be used in other combinations than those shown and described.

It will be understood, that each of the elements described above or two or more together, may also find a useful application in other types of construction differing from the types described above.

While the invention has been illustrated and described as embodied in a circular knitting machine, it is not intended to be limited to the details shown, since various modifications and structural changes may be made without departing in any way from the spirit of the present invention.

Without further analysis, the forgoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Circular knitting machine comprising: a chassis (1), means for manufacturing knitted goods and at least one working platform (14, 27, 37) facilitating access to an upper region of the machine, movably mounted on an outside of said chassis (1) and extending over a fraction of a periphery of said chassis (1), wherein said working platform (14, 27, 37) is displaceably mounted on a guideway (23) attached to said chassis (1) and running in a peripheral direction of said chassis (1).

2. Circular knitting machine according to claim 1, wherein said working platform (14, 27, 37) is at least partially provided with a safety railing (18, 31).

3. Circular knitting machine according to claim 1 and having two working platforms (27, 37) movable independently of each other.

4. Circular knitting machine according to claim 1, wherein said working platform (14, 27, 37) is formed on a top of a set of steps (15, 28, 38) having at least one step (16, 17; 29, 30).

5. Circular knitting machine according to claim 2, wherein said working platform (14, 27, 37) is formed on a top of a set of steps (15, 28, 38) having at least one step (16, 17; 29, 30).

6. Circular knitting machine according to claim 4, wherein said steps (16, 17) are arranged one behind the other in a radial direction of said chassis (1).

7. Circular knitting machine according to claim 4, wherein said steps (29, 30) are arranged one behind the other in said peripheral direction.

8. Circular knitting machine according to claim 6, wherein said safety railing (18) has an access opening (19) lying radially outwards.

9. Circular knitting machine according to claim 7, wherein, seen in said peripheral direction, said safety railing (31) is provided at one end with an access opening (32) and at an end situated opposing this, with a protective grid (33, 40).

10. Circular knitting machine according to claim 1, wherein said chassis (1) has at least one radially projecting main foot (2) provided with two side faces (2*a*, 2*b*) and a displacement path arranged between said two side faces (2*a*, 2*b*) and delimited by said side faces (2*a*, 2*b*) is assigned to said working platform (14, 27, 37).

11. Circular knitting machine according to claim 1, and further comprising two working platforms (27, 37) having safety railings (31) according to claim 8, said railings (31) being provided with access openings (32, 39) facing towards each other.

12. Circular knitting machine according to claim 11, wherein said protective grids (33, 40) of both safety railings (31) face towards said side faces (2*a*, 2*b*) of said main foot (2).

13. Circular knitting machine according to claim 1, wherein said chassis (1) has at least two radially extending feet (2, 3, 4) and wherein between each pair of said feet (2, 3, 4), at least one working platform according to claim 1 is arranged.

14. Circular knitting machine according to claim 1, wherein that the working platform (14, 27, 37) or said set of steps (15, 28, 38) is supported on at least one rotatable roller (21, 34).

15. Construction kit for a working platform (14, 27, 37) of a circular knitting machine, comprising a guideway (23) designed for attaching to a chassis (1) of said circular knitting machine and at least one working platform (14, 27, 37) designed according to claim 1, and connectable to said guideway (23) and displaceable along said guideway (23).

* * * * *

UNITED STATES PATENT AND TRADEMARK OFFICE

CERTIFICATE OF CORRECTION

PATENT NO. : 6,983,625 B2
APPLICATION NO. : 10/863404
DATED : January 10, 2006
INVENTOR(S) : H. Weber et al.

It is certified that error appears in the above-identified patent and that said Letters Patent is hereby corrected as shown below:

Col. 6, lines 36-44 should read,
1. Circular knitting machine comprising: a chassis (1), means for manufacturing knitted goods and at least one working platform (14, 27, 37) facilitating access to an upper region of the machine, movably mounted on an outside of said chassis (1) and extending over a fraction of a periphery of said chassis (1), wherein said working platform (14, 27, 37) is displaceably mounted on a guideway (23) attached to said chassis (1) and running in a peripheral direction of said chassis (1), wherein said working platform (14, 27, 37) is formed on a top of a set of steps (15, 28, 38) having at least one step (16, 17, 29, 30), wherein said steps (29, 30) are arranged one behind the other in said peripheral direction, safety railing (31) is provided at one end with an access opening (32) and at an end situated opposing this, with a protective grid (33, 34).

Col. 6, lines 45-47 should read,
2. Circular knitting machine comprising: a chassis (1), means for manufacturing knitted goods and at least one working platform (14, 27, 37) facilitating access to an upper region of the machine, movably mounted on an outside of said chassis (1) and extending over a fraction of a periphery of said chassis (1), wherein said chassis (1) has at least one radially projecting main foot (2) provided with two side faces (2a, 2b) and a displacement path arranged between said two faces (2a, 2b) and delimited by said side faces (2a, 2b) is assigned to said working platform (14, 27, 37).

Col. 6, lines 48-50 should read,
3. Circular knitting machine comprising: a chassis (1), means for manufacturing knitted goods and at least one working platform (14, 27, 37) facilitating access to an upper region of the machine, movably mounted on an outside of said chassis (1) and extending over a fraction of a periphery of said chassis (1), and further comprising two working platforms (27, 37) having safety railings (31) according to Claim 13, said railings (31) being provided with access openings (32, 39) facing towards each other.

Col. 6, lines 51-54 should read,
4. Circular knitting machine according to Claim 3, wherein said protective grids (33, 40) of both safety railings (31) face towards said side faces (2a, 2b) of said main foot (2).

UNITED STATES PATENT AND TRADEMARK OFFICE

CERTIFICATE OF CORRECTION

PATENT NO. : 6,983,625 B2
APPLICATION NO. : 10/863404
DATED : January 10, 2006
INVENTOR(S) : H. Weber et al.

It is certified that error appears in the above-identified patent and that said Letters Patent is hereby corrected as shown below:

Col. 6, lines 55-60 should read,
5. Circular knitting machine comprising: an axis (11), a chassis (1), means for manufacturing knitting goods, guiding means (23) attached to an extending in a peripheral direction of said chassis (1), and at least one working platform (14, 27, 37) having at least one displacement means (21, 34) for supporting said platform (14, 27, 37) on a floor and fixing means (25) for fixing said platform (14, 27, 37) substantially immovably to said guiding means (23) in a radial direction with respect to said axis (11) but permitting displacement of said platform (14, 27, 37) in said peripheral direction, wherein said guiding means (23), said sliding means (25) and said displacement means (21, 34) are designed such that said platform (14, 27, 37) can be moved in said peripheral direction without dismounting it from said guiding means (23).

Col. 6, lines 61-62 should read,
6. Circular knitting machine according to Claim 5, wherein said displacement means (21, 34) has at least one rotatable roller.

Col. 6, lines 63-64 should read,
7. Circular knitting machine according to claim 5, wherein said working platform (14, 27, 37) is at least partially provided with a safety railing (18, 31).

Col. 6, lines 65-67 should read,
8. Circular knitting machine according to Claim 5, and having two working platforms (27, 37) movable independently of each other.

Col. 7, lines 1-3 should read,
9. Circular knitting machine according to Claim 5, wherein said working platform (14, 27, 37) is formed on a top of a set of steps (15, 28, 38) having at least one step (16, 17, 29, 30).

Col. 7, lines 4-5 should read,
10. Circular knitting machine according to Claim 7, wherein said working platform (14, 27, 37) is formed on a top of a set of steps (15, 28, 38) having at least one step (16, 17, 29, 30).

Col. 7, lines 6-7 should read,
11. Circular knitting machine according to Claim 9, wherein said steps (16, 17) are arranged one behind the other in a radial direction of said chassis (1).

UNITED STATES PATENT AND TRADEMARK OFFICE

CERTIFICATE OF CORRECTION

PATENT NO. : 6,983,625 B2
APPLICATION NO. : 10/863404
DATED : January 10, 2006
INVENTOR(S) : H. Weber et al.

It is certified that error appears in the above-identified patent and that said Letters Patent is hereby corrected as shown below:

Col. 7, lines 8-9 should read,
12. Circular knitting machine according to Claim 9, wherein said steps (29, 30) are arranged one behind the other in said peripheral direction.

Col. 8, lines 1-2 should read,
13. Circular knitting machine according to Claim 11, wherein said safety railing (18) has an access opening (19) lying radially outwards.

Col. 8, lines 3-4 should read,
14. Circular knitting machine according to Claim 5, wherein said chassis (1) has at least two radially extending feet (2, 3, 4) and wherein between each pair of said feet (2, 3, 4) at least one working platform according to Claim 1 is arranged.

Col. 8, lines 5-8 should read,
15. Construction kit for a working platform (14, 27, 37) of a circular knitting machine, comprising a guideway (23) designed for attaching to a chassis (1) of said circular knitting machine and at least one working platform (14, 27, 37) designed according to Claim 5, and connectable to said guideway (23) and displaceable along said guideway 23.

Signed and Sealed this

Seventh Day of October, 2008

JON W. DUDAS
*Director of the United States Patent and Trademark Office*